US005396534A

United States Patent [19]

Thomas

[11] Patent Number: 5,396,534

[45] Date of Patent: Mar. 7, 1995

[54] SHUTTER APPARATUS FOR COLLIMATING X-RAYS

[76] Inventor: Howard C. Thomas, 10330 N. Meade Loop, Westminster, Colo. 80030

[21] Appl. No.: 135,090

[22] Filed: Oct. 12, 1993

[51] Int. Cl.[6] ..... G21K 1/02

[52] U.S. Cl. ..... 378/160; 378/147; 378/152

[58] Field of Search ..... 378/145, 147–153, 378/159, 160

[56] References Cited

U.S. PATENT DOCUMENTS

| | | | |
|---|---|---|---|
| 2,921,202 | 1/1960 | Berger et al. | 378/151 |
| 3,609,370 | 9/1971 | Peyser | 378/153 |
| 3,829,701 | 8/1974 | Hura | 378/153 |
| 3,936,647 | 2/1976 | Feketè | 378/153 |
| 4,167,675 | 9/1979 | Stodberg et al. | 378/153 |
| 4,246,488 | 1/1981 | Hura | 378/151 |
| 4,380,820 | 4/1983 | Cutter | 378/152 |
| 4,389,730 | 6/1983 | Cutter | 378/153 |
| 4,489,426 | 12/1984 | Grass et al. | 378/150 |
| 4,514,859 | 4/1985 | Holzermer | 378/152 |
| 4,641,335 | 2/1987 | Hahn | 378/153 |
| 5,012,506 | 4/1991 | Span et al. | 378/152 |

*Primary Examiner*—David P. Porta
*Assistant Examiner*—Don Wong
*Attorney, Agent, or Firm*—Dorr, Carson, Sloan & Peterson

[57] ABSTRACT

A shutter mechanism for collimating x-rays uses a frame to define an opening with two opposing interior edges. An elongated flexible band extends in sliding engagement about at least a portion of the periphery of the frame opening. A first shutter member made of an x-ray opaque material has a first end attached to the flexible band along the first interior edge of the frame. Similarly, a second shutter member made of an x-ray opaque material has a first end attached to the flexible band along the second interior edge of the frame. A drive means, such as a stepper motor, translates the flexible band relative to the frame to control the positions of the shutter members and the shutter aperture. In the preferred embodiment, the interior edges of the frame also include tracks that slidably engage the opposing edges of the shutter members for support. Two or more of these frame assemblies can be stacked in a rotated orientation about a common axis to provide two-dimensional control of the size of the shutter aperture.

19 Claims, 8 Drawing Sheets

SHUTTER APPARATUS FOR COLLIMATING X-RAYS

BACKGROUND OF THE INVENTION

1. Field of the Invention

The present invention relates generally to the field of devices for collimating x-rays. More specifically, the present invention discloses a simplified shutter mechanism using a flexible band extending about a frame opening to directly control the position of two shutters.

2. Statement of the Problem

Shutter mechanisms for x-ray collimators present a unique set of design requirements. The shutters are typically made of a radio-opaque material, such as lead. This results in shutter plates that have substantial weight. In addition, x-ray diagnostic devices used in medical and dental offices are subject to .very tight space limitations. Therefore, the shutter mechanism must be as compact as possible. Finally, safety of the patient and health care providers is always a paramount concern. This dictates that the shutter mechanism must be capable of a high degree of positional accuracy to ensure an accurate x-ray dosage to the patient through a well-defined aperture and to prevent accidental exposure of others.

Existing shutter mechanisms have a number of shortcomings. Most commercially available shutter mechanisms for x-ray collimators involve a relatively complex linkage mechanism and/or a series of gears to move the shutter plates. This complexity increases the size, cost, and positional tolerances of the shutter mechanism, and can also lead to reliability problems.

A number of shutter mechanisms for x-ray collimators have been invented in the past, including the following:

| Inventor | U.S. Pat. No. | Issue Date |
|---|---|---|
| Span et al. | 5,012,506 | Apr. 30, 1991 |
| Hahn | 4,641,335 | Feb. 3, 1987 |
| Holzermer | 4,514,859 | Apr. 30, 1985 |
| Grass et al. | 4,489,426 | Dec. 18, 1984 |
| Cutter | 4,389,730 | June 21, 1983 |
| Cutter | 4,380,820 | Apr. 19, 1983 |
| Hura | 4,246,488 | Jan. 20, 1981 |
| Stödberg et al. | 4,167,675 | Sep. 11, 1979 |
| Fekete | 3,936,647 | Feb. 3, 1976 |
| Hura | 3,829,701 | Aug. 13, 1974 |
| Peyser | 3,609,370 | Sep. 28, 1971 |

Span et al. disclose a multileaf collimator having first and second pairs of leaves 30, 31 and 35, 36 at right angles. The leaves are independently adjustable.

Holzermer discloses an x-ray collimator with orthogonal rectangular diaphragm plates and a plurality of additional triangular diaphragm plates for pivotal movement into the four corner regions of the opening defined by the rectangular diaphragm plates. Each triangular plate is moved by a parallelogram linkage. The linkages are driven in unison by a stepper motor 47 and a continuous belt 45.

Hahn discloses a collimator for a stereo radiographic x-ray system with adjustable shutter leaves.

Grass et al. disclose another example of an x-ray collimator with an adjustable aperture.

The Cutter patents disclose two variations of a compact collimator with two orthogonally-disposed pairs of shutters. Mating inner edges of each pair move in a rectilinear path.

The Hura patents disclose two radiation collimators having orthogonal pairs of shutters that are driven by mechanical linkages.

Stödberg et al., Fekete, and Peyser disclose other examples of x-ray collimators using mechanical linkages and/or gears to control the position of shutters.

3. Solution to the Problem

None of the prior art references uncovered in the search show a simplified shutter mechanism for collimating x-rays that uses an elongated flexible band coupled to a drive means, such as a stepper motor, to directly control the position a pair of shutter plates without intermediate mechanical linkages or gears.

SUMMARY OF THE INVENTION

This invention provides an improved shutter mechanism for collimating x-rays. The device includes a frame having an opening with two opposing interior edges. An elongated flexible band extends in sliding engagement about at least a portion of the periphery of the frame opening. A first shutter member made of an x-ray opaque material has a first end attached to the flexible band along the first interior edge of the frame. Similarly, a second shutter member made of an x-ray opaque material has a first end attached to the flexible band along the second interior edge of the frame. A drive means, such as a stepper motor, translates the flexible band relative to the frame to control the positions of the shutter members and the shutter aperture. In the preferred embodiment, the interior edges of the frame also include tracks that slidably engage the opposing edges of the shutter members for support. Two or more of these frame assemblies can be stacked in a rotated orientation about a common axis to provide two-dimensional control of the size of the shutter aperture.

A primary object of the present invention is to provide a shutter mechanism for collimating x-rays that requires a substantially reduced number of component parts, thereby decreasing the cost of production and increasing reliability.

Another object of the present invention is to provide a shutter mechanism that can be easily repaired.

Another object of the present invention is to provide a shutter mechanism that offers a high degree of positional accuracy and repeatability in regard to the size and location of the shutter aperture.

Yet another object of the present invention is to provide a shutter mechanism that is very compact and can be easily stacked for two-dimensional control of the shutter aperture.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
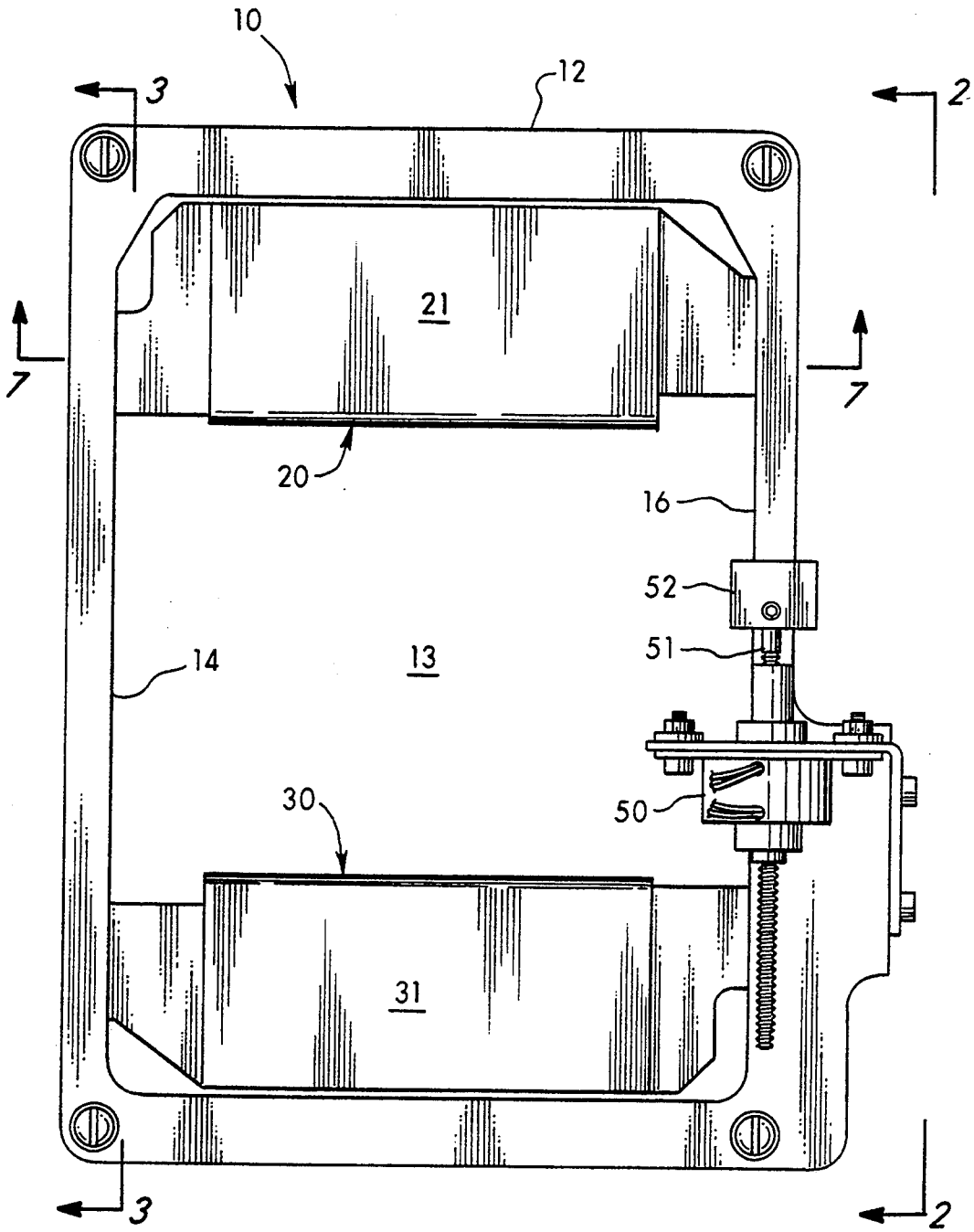
FIG. 1 is a front plan view of a shutter assembly showing the frame and two shutters.
Figure 2:
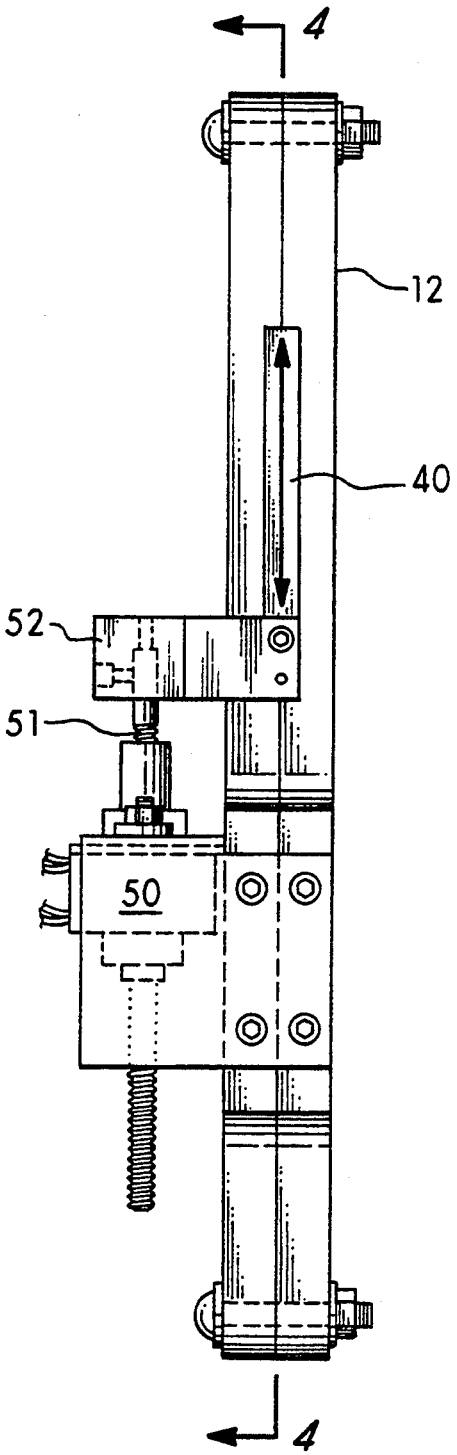
FIG. 2 is a side plan view of the shutter assembly corresponding to FIG. 1.
Figure 8:
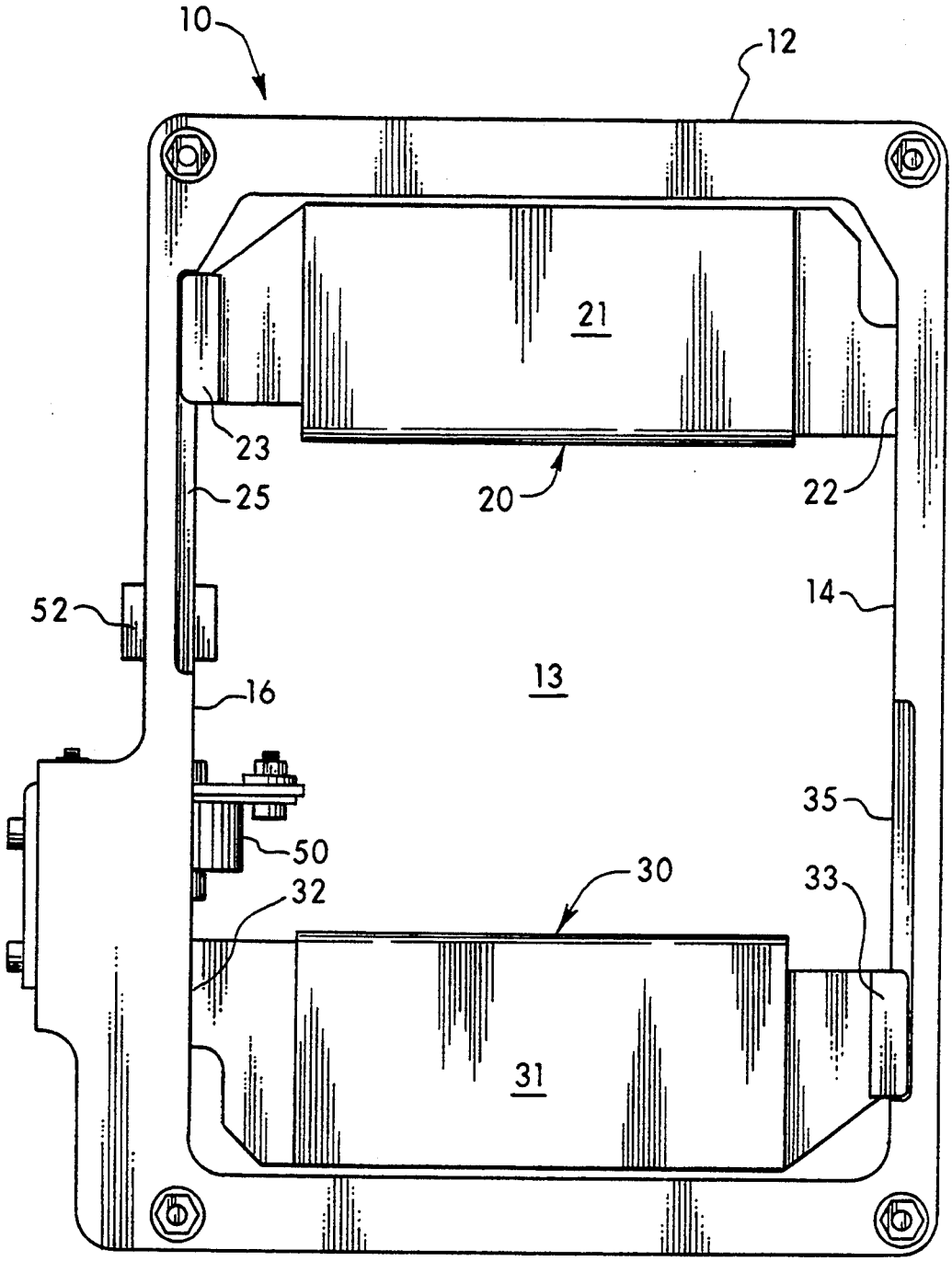
FIG. 8 is a rear plan view of the shutter assembly.

Turning to FIG. 1, a front plan view of one shutter assembly 10 is provided. A corresponding side plan view is shown in FIG. 2 and a rear plan view is shown in FIG. 8. The frame 12 defines an opening 13 with two opposed interior edges 14, 16 that extend generally parallel to the direction of motion for the two shutter members 20 and 30. For example, the opening 13 can be substantially rectangular in shape, although other geometric shapes having at least two opposing edges could be employed. The plane of the frame opening 13 is usually substantially normal to the axis of the x-ray beam being collimated.

Figure 7:
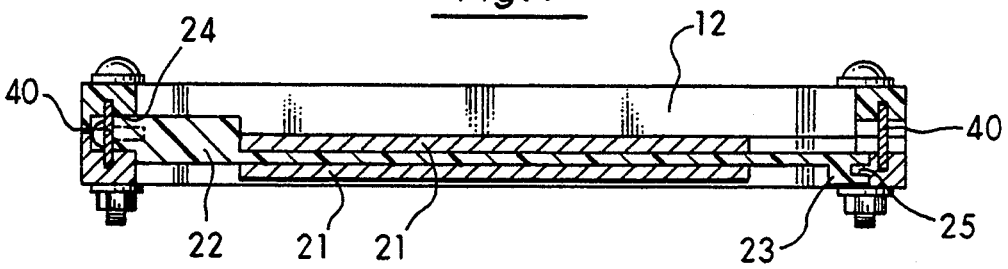
FIG. 7 is a cross-sectional view of one of the shutters and upper portion of the frame as indicated on FIG. 1.

The shutter members 20 and 30 are made of a radio-opaque material such as lead. In the preferred embodiment, the shutter members 20, 30 are molded from plastic to simplify fabrication and then selected portions are sheathed with a layer of lead 21 and 31, as shown in FIGS. 1 and 7.

Figure 4:
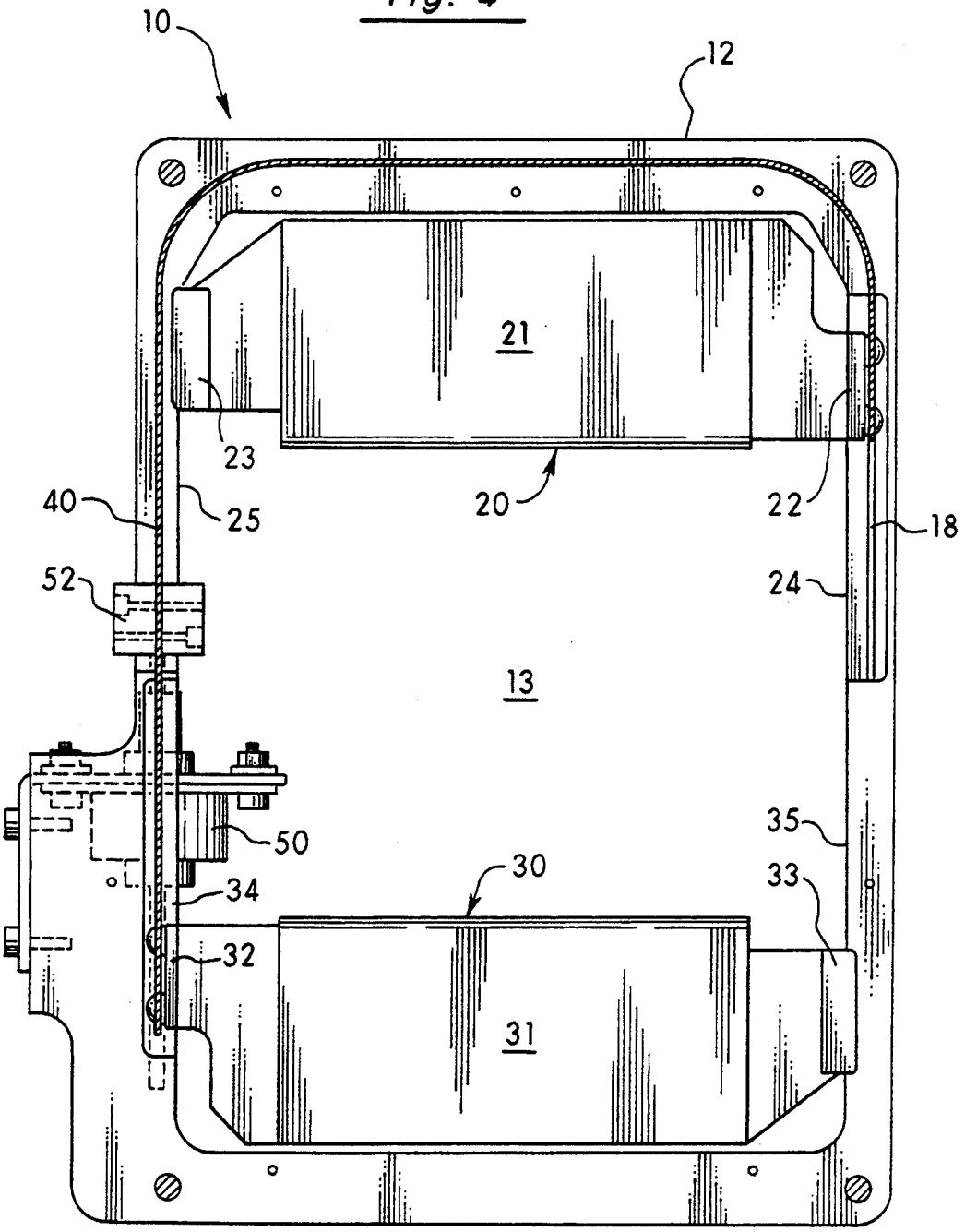
FIG. 4 is a rear plan view of the shutter assembly with the rear portion of the frame removed showing the flexible band and the track extending about the interior of the frame with the shutters in an open position.
Figure 5:
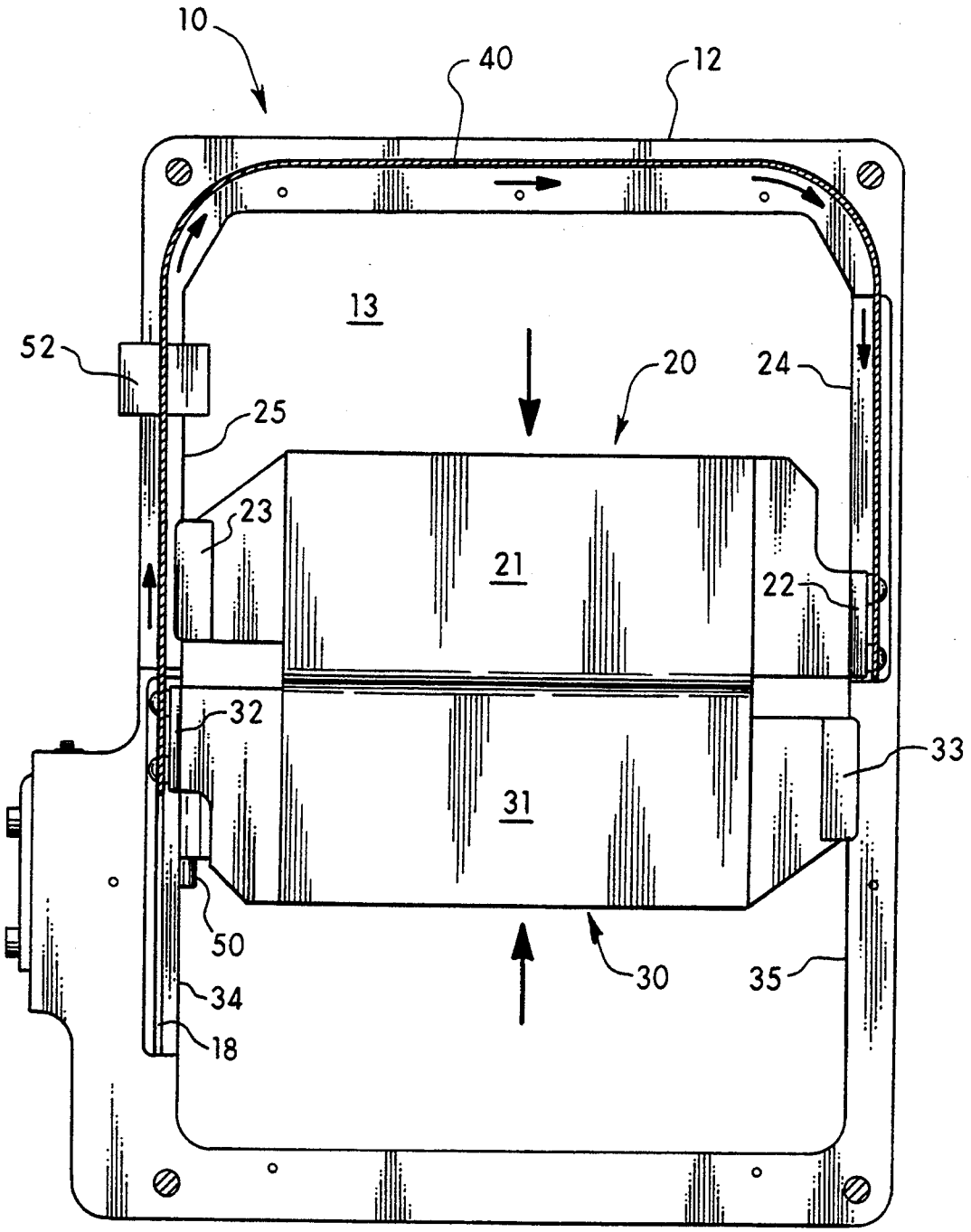
FIG. 5 is a rear view of the shutter assembly with the rear portion of the frame removed showing the flexible band and the track extending about the interior of the frame with the shutters in a closed position.
Figure 6:
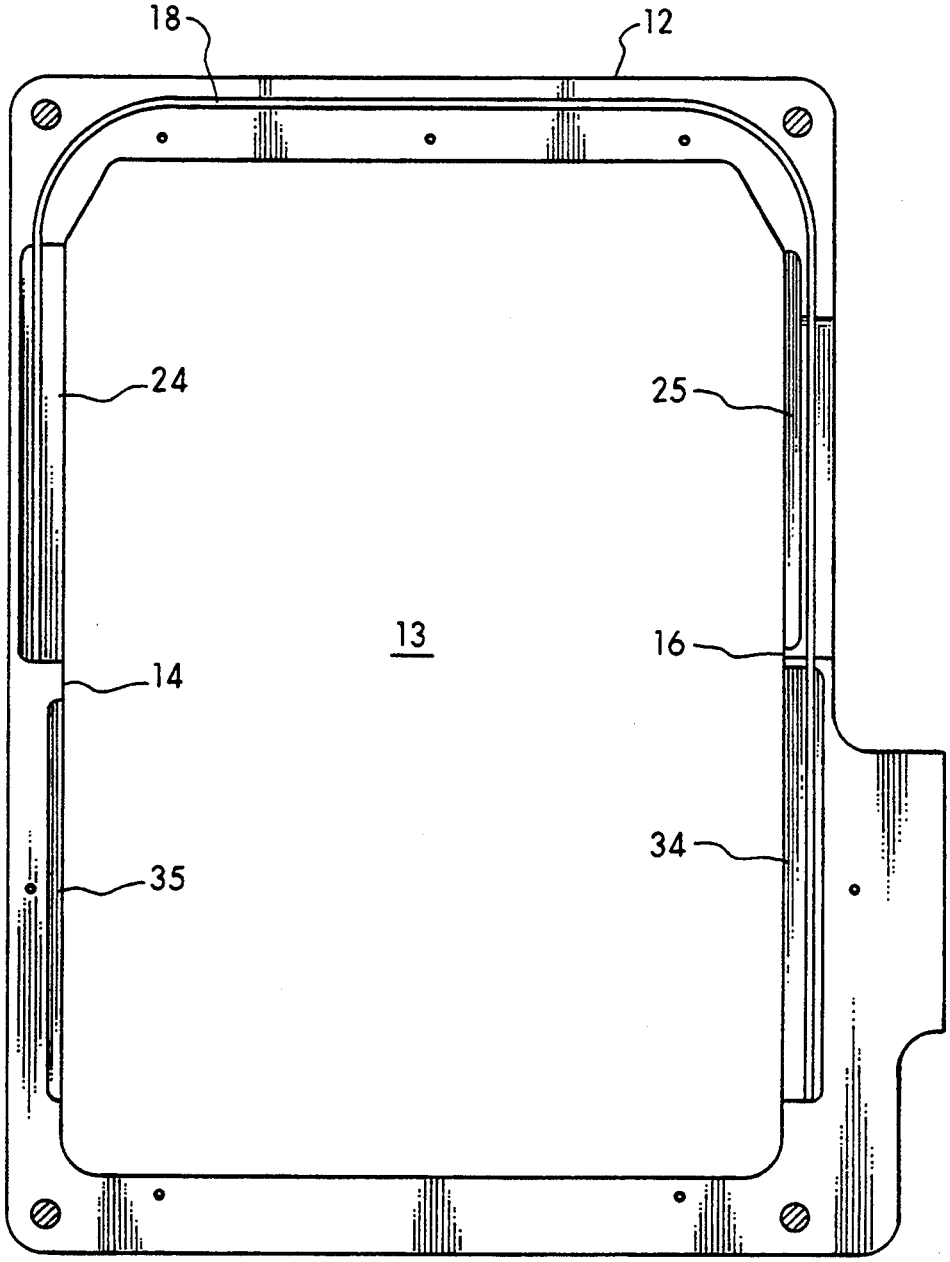
FIG. 6 is a front view of the rear portion of the frame.

FIGS. 4 and 5 show a rear view of the shutter assembly with the rear portion of the frame 12 removed to reveal the interior channel 18 extending about a portion of the periphery of the frame opening 13. FIG. 6 is a corresponding front view of the rear portion of the frame that was removed in FIGS. 4 and 5. The channel 18 can extend completely around the periphery of the frame opening 13, or alternatively, the channel 18 need only extend about a portion of the periphery of the frame opening 13, as will be discussed below.

The channel holds an elongated flexible band 40 that can slide freely within the channel 18 along at least a portion of the periphery of the frame opening 13. Although the preferred embodiment of the frame 12 shown in the drawings employs an interior channel 13 to hold the flexible band 40, it should be understood that other alternative embodiments are feasible. For example, the channel could be formed partially or completely on the exterior of the frame. It would also be possible to eliminate large sections of the channel, for example, by suspending the flexible band between rollers mounted at the interior corners of the frame opening. However, an interior channel offers the advantages of minimizing accumulation of dust and dirt in the channel and on the flexible band, and can be used to provide additional support and guidance for the ends of the shutter members as they slide within the frame opening.

In the preferred embodiment, the band 40 is made of a relatively thin strip of flexible plastic. Alternatively, the band can be made of a thin flexible metal strip, rubber, natural fiber, or other flexible materials, either singly or in a composite structure. In addition, the band can be fabricated as a cable, belt, single strand, or chain.

A drive means 50, such as a stepper motor, is employed to control the position of the flexible band 40 in the channel 18. In the particular embodiment shown in the drawings, the stepper motor 50 drives a worm gear 51 that exerts a translational force on a sliding block 52 attached to the band 40, as shown most clearly in FIGS. 1, 2, and 4. Other types of drive means, such as a linear actuator motor, a solenoid, or a stepper motor with a cam arrangement, could be readily substituted. In particular, a servo-motor having a cog or gear attached to its drive shaft could be used to engage a series of notches or holes extending along the band.

Figure 3:
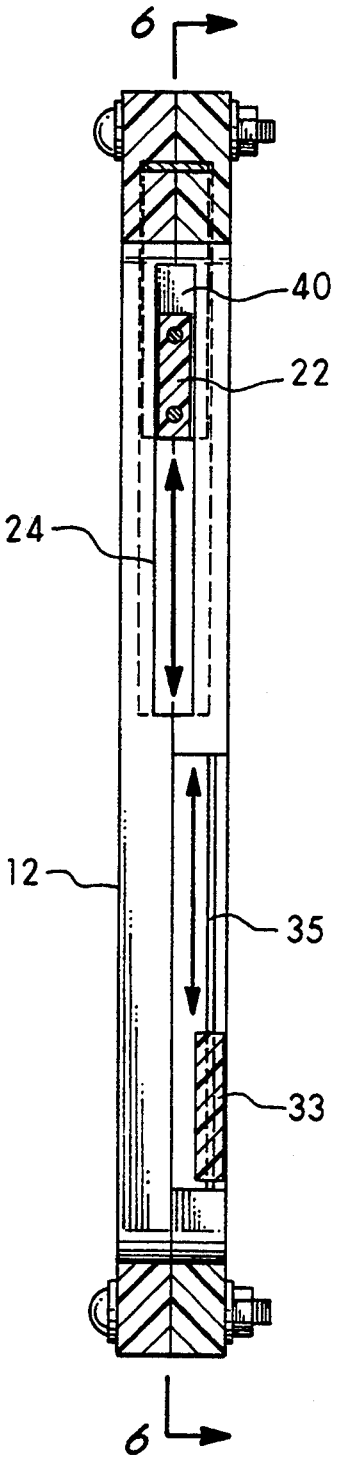
FIG. 3 is cross-sectional view of the left edge of the shutter assembly as indicated in FIG. 1.

Both of the shutter members 20 and 30 are attached to the flexible band 40 through slots 24 and 34 in the opposing edges 14 and 16, respectively, of the frame 12. As shown in FIGS. 3, 4, and 5, one end 22 of the first shutter member 20 is inserted through a slot 24 in the upper portion of left interior edge of the frame and secured to the flexible band 40. Similarly, the opposite end 32 of the second shutter member 30 is inserted through a slot 34 in the lower portion of the right interior edge of the frame and secured to the flexible band 40. In the preferred embodiment, the remaining ends 23 and 33 of the shutter members 20 and 30 slidably engage tracks 25 and 35, respectively, extending along the corresponding interior edges of the frame. The tracks 25 and 35 are shown most clearly in the lower portion of FIG. 3 and the right portion of FIG. 7. In particular, the first track 35 extends along the lower portion of the first interior edge 14 of the frame 12 and slidably engages the second end 33 of the second shutter member 30. Similarly, the second track 25 extends along the upper portion of the second interior edge 16 of the frame 12 and slidably engages the second end 23 of the first shutter member 20. In other words, the first track 35 is located across the frame opening 13 from the second slot 34, and the second track 25 is located across the frame opening from the first slot 24. These tracks 25 and 35 provide added structural support and help maintain accurate alignment for the shutter members 20 and 30.

FIGS. 4 and 5 demonstrate how the shutter members move between an open position (FIG. 4) and a closed position (FIG. 5) as the stepper motor 50 causes the flexible band 40 to translate within the channel 18 relative to the frame 12. The slots 24, 34 and/or tracks 25, 25 can be used to define the maximum range of motion for the shutter members 20, 30 within the frame opening 13.

It has been previously noted that the channel 18 can extend either completely or only partially around the periphery of the frame opening 13. The drawings depict an embodiment of the invention in which the channel 18 extends only partially about the frame opening. This same design choice applies to the flexible band 40, which also can extend either partially or completely around the frame opening depending on the selected configuration of the channel 18. If the channel 18 and band 40 extend only partially around the frame opening, the band 40 will pull one shutter member and push the other shutter member depending on the direction of motion of the band 40. The narrow cross-sectional dimensions of the channel 18 prevent the band 40 from buckling while pushing a shutter member. For example, in moving from the open position shown in FIG. 4 to the closed position shown in FIG. 5, the band 40 pushes on the first shutter member 20 and pulls on the second shutter member 30. Conversely, the band 40 pulls on the first shutter member 20 and pushes on the second shutter member 30 to open the shutter aperture. Alternatively, if the band 40 and channel 18 extend completely around the periphery of the frame opening to form a complete loop, the band 40 will simultaneously pull on both shutter members 20 and 30, and thereby eliminate any potential problem of buckling.

The control system for regulating the positions of the shutter members 20 and 30 can either operate with positional feedback (closed-loop) or without positional feedback (open-loop). If a stepper motor is employed as the drive means 50, the controller can keep track of the location of the shutter members 20 and 30 by counting the number of electrical pulses it has sent to the stepper motor. However, this does not provide positive verification that the shutter members have, in fact, moved to the desired position. For example, the controller would have no way to know if the stepper motor is broken, the band has broken, or the mechanism is jammed or otherwise nonfunctional. This shortcoming can be addressed by providing the controller with feedback as to the actual positions of the band and/or shutter members. For example, a small rack gear can be attached to the band. This engages the teeth on a pinion gear secured to the shaft of a potentiometer. The controller can then continually measure the resistance of the potentiometer to monitor the position of the band.

Figure 9:
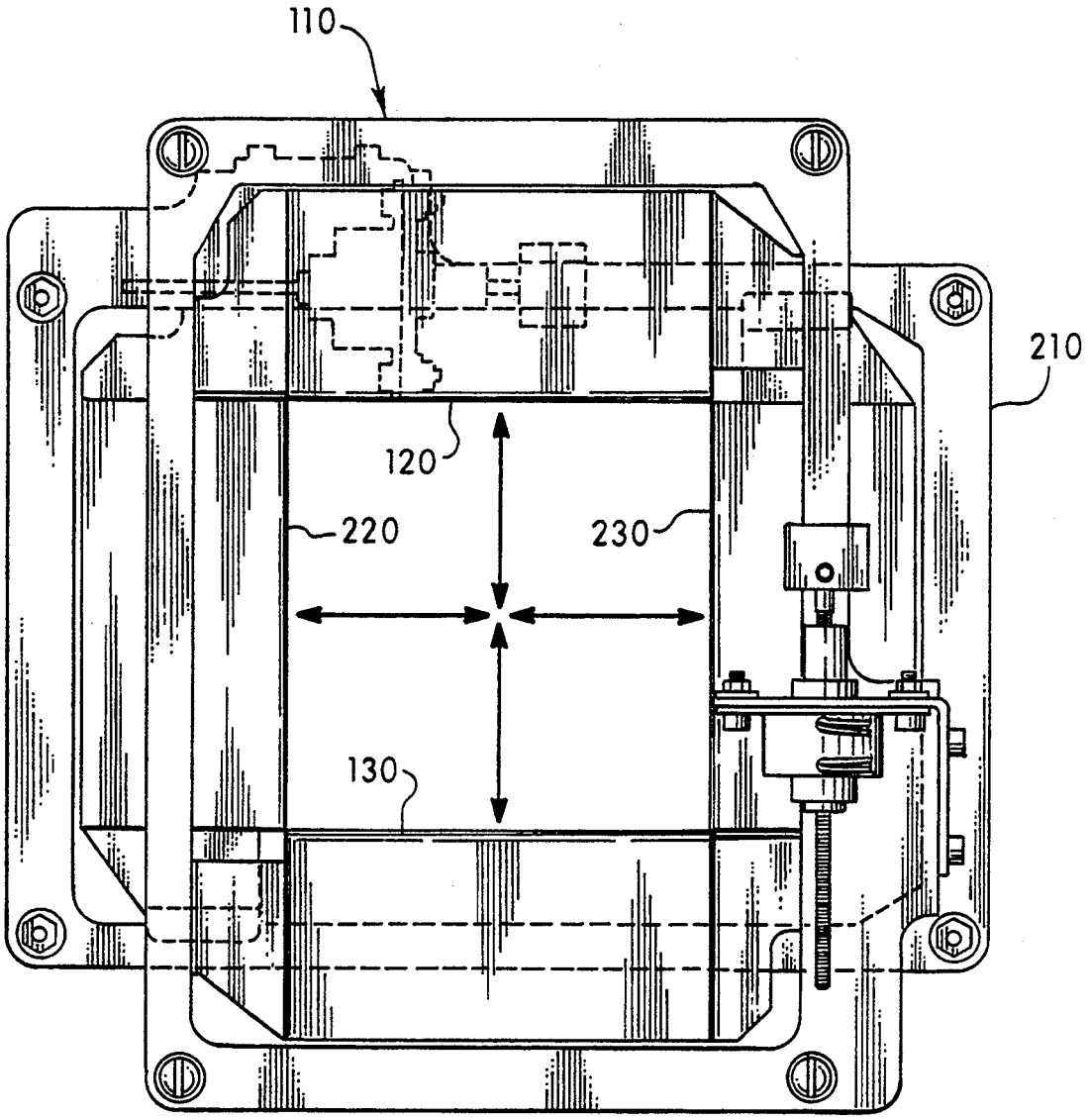
FIG. 9 is a top plan view of two shutter assemblies that have been orthogonally stacked to provide two-dimensional control of the aperture size.
Figure 10:
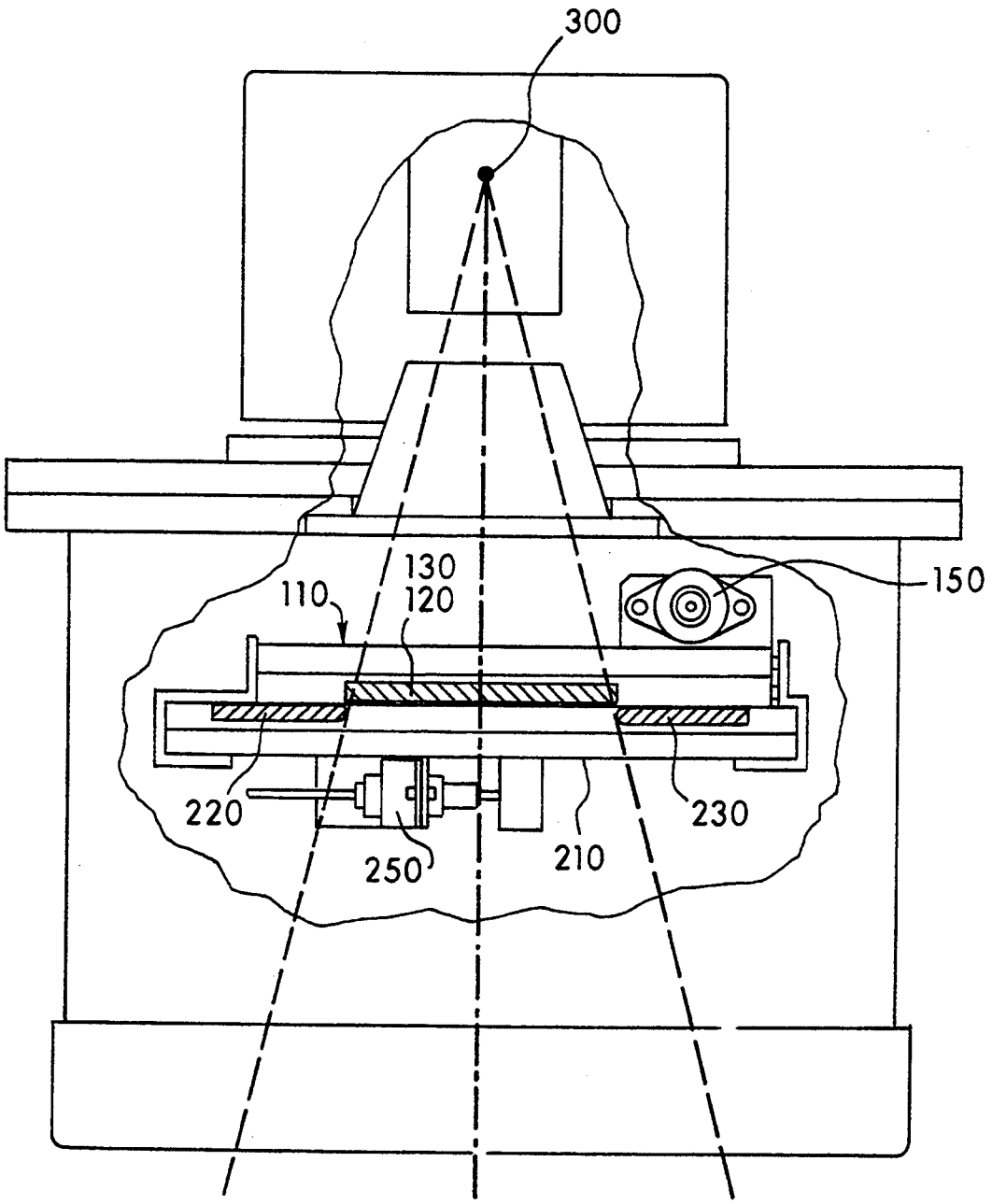
FIG. 10 is a side view showing two orthogonally stacked shutter assemblies incorporated into a conventional radiotherapy device.

FIG. 9 shows multiple shutter assemblies 110 and 210 orthogonally stacked along a common axis to provide two-dimensional control of the size and shape of the resulting aperture. FIG. 10 is a side cross-sectional view of the two orthogonally stacked shutter assemblies 110, 210 incorporated into a conventional x-ray generator. Each of the shutter assemblies 110, 210 has essentially the same configuration and components as the shutter assembly 10 previously discussed and shown in FIGS. 1–9. The frame opening of each shutter assembly is substantially orthogonal to a common axis passing through the x-ray source 300. In addition, the shutter assemblies 110 and 210 are oriented substantially orthogonally to one another (i.e., the shutter assemblies are rotated 90 degrees with respect to one another about the common axis). The top shutter assembly 110 provides two shutter members 120 and 130 that define the size of the aperture in the Y direction, and the bottom shutter assembly 210 provides two shutter members 220 and 230 that define the size of the aperture in the X direction. Each pair of shutter members 120, 130 and 220, 230 is independently controllable by the stepper motor 150 or 250 associated with its respective shutter assembly.

In an alternative embodiment, a single stepper motor and a single flexible band can be use to position more than two shutter members within a single frame. For example, two pairs of shutter members can be driven by the same band in a square or rectangular frame opening. The first pair of shutter members is attached to the band along the top and bottom interior edges of the frame to regulate the aperture size in the X direction. The second pair of shutter members is attached to the band along the left and right interior edges of the frame to regulate the aperture size in the Y direction. This concept could be further extended to provide three pairs of shutter members attached to opposing pairs of edges in a hexagonal frame, or four pairs of shutter members in an octagonal frame, etc.

The above disclosure sets forth a number of embodiments of the present invention. Other arrangements or embodiments, not precisely set forth, could be practiced under the teachings of the present invention and as set forth in the following claims.

We claim:

1. A shutter apparatus for collimating x-rays comprising:

a frame defining an opening with first and second opposing interior edges;

an elongated flexible band extending in slidable engagement about at least a portion of said opening in said frame;

drive means for translating said flexible band relative to said frame;

a first shutter member made of an x-ray opaque material having a first end attached to said flexible band along said first interior edge; and a second shutter member made of an x-ray opaque material having a first end attached to said flexible band along said second interior edge.

2. The shutter apparatus of claim 1, wherein said first and second interior edges of said frame further comprise track means, said first shutter member further comprises a second end for slidably engaging said track means of said second interior edge, and said second shutter member further comprises a second end for slidably engaging said track means of said first interior edge.

3. The shutter apparatus of claim 1, wherein said frame has a channel extending around at least a portion of the periphery of said opening to hold said elongated flexible band.

4. The shutter apparatus of claim 1, wherein said first end of said first shutter member is attached to said elongated flexible band through a first slot in said first edge of said frame, and said first end of said second shutter member is attached to said elongated flexible band through a second slot in said second edge of said frame, whereby said slots define a maximum range of motion for said shutter members within said opening.

5. The shutter apparatus of claim 1, wherein said drive means comprises a stepper motor.

6. The shutter apparatus of claim 1, wherein said elongated flexible band comprises a thin strip of plastic.

7. The shutter apparatus of claim 1, wherein said frame has a substantially rectangular opening.

8. A shutter apparatus for collimating x-rays comprising:

a frame defining an opening with first and second opposing interior edges, said frame further having:

(a) an interior channel extending about at least a portion of said opening;

(b) a first slot extending through said first edge to said interior channel;

(c) a second slot extending through said second edge to said interior channel;

(d) a first track extending along at least a portion of said first edge opposite said second slot; and (e) a second track extending along at least a portion of said second edge opposite said first slot;

an elongated flexible band extending in slidable engagement in said interior channel of said frame;

drive means for translating said flexible band relative to said frame;

a first shutter member made of an x-ray opaque material having a first end extending through said first slot and attached to said flexible band within said interior channel of said frame, and a second end for slidably engaging said second track; and a second shutter member made of an x-ray opaque material having a first end extending through said second slot and attached to said flexible band within said interior channel of said frame, and a second end for slidably engaging said first track.

9. The shutter apparatus of claim 8, wherein said drive means comprises a stepper motor.

10. The shutter apparatus of claim 8, wherein said elongated flexible band comprises a thin strip of plastic.

11. The shutter apparatus of claim 8, wherein said first and second slots define a maximum range of motion for said shutter members within said frame opening.

12. The shutter apparatus of claim 8, wherein said frame has a substantially rectangular opening.

13. A shutter apparatus for collimating x-rays comprising a first shutter assembly and a second shutter assembly, each of said shutter assemblies having:

a frame defining an opening substantially orthogonal to a predetermined axis with first and second opposing interior edges;

an elongated flexible band extending in slidable engagement about at least a portion of said opening;

drive means for translating said flexible band relative to said frame;

a first shutter member made of an x-ray opaque material having a first end attached to said flexible band along said first interior edge; and a second shutter member made of an x-ray opaque material having a first end attached to said flexible band along said second interior edge; wherein said first shutter assembly and said second shutter assembly are oriented substantially orthogonally to one another.

14. The shutter apparatus of claim 13, wherein said first and second interior edges of said frame further comprise track means, said first shutter member further comprises a second end for slidably engaging said track means of said second interior edge, and said second shutter member further comprises a second end for slidably engaging said track means of said first interior edge.

15. The shutter apparatus of claim 13, wherein said frame further comprises a channel extending around at least a portion of the periphery of said opening to hold said elongated flexible band.

16. The shutter apparatus of claim 13, wherein said first end of said first shutter member is attached to said elongated flexible band through a first slot in said first edge of said frame, and said first end of said second shutter member is attached to said elongated flexible band through a second slot in said second edge of said frame, whereby said slots define a maximum range of motion for said shutter members within said opening.

17. The shutter apparatus of claim 13, wherein said drive means comprises a stepper motor.

18. The shutter apparatus of claim 13, wherein said elongated flexible band comprises a thin strip of plastic.

19. The shutter apparatus of claim 13, wherein said frame has a substantially rectangular opening.

* * * * *